US011623459B2

(12) United States Patent
Ito et al.

(10) Patent No.: US 11,623,459 B2
(45) Date of Patent: Apr. 11, 2023

(54) RECORDING APPARATUS AND MEDIUM HOUSING APPARATUS

(71) Applicant: SEIKO EPSON CORPORATION, Tokyo (JP)

(72) Inventors: Shun Ito, Matsumoto (JP); Atsuhiko Takeuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/445,763

(22) Filed: Aug. 24, 2021

(65) Prior Publication Data

US 2022/0063305 A1 Mar. 3, 2022

(30) Foreign Application Priority Data

Aug. 27, 2020 (JP) ..... JP2020-143305

(51) Int. Cl.
*B41J 11/00* (2006.01)
*B41J 13/10* (2006.01)
*B41J 11/42* (2006.01)

(52) U.S. Cl.
CPC ..... *B41J 11/42* (2013.01)

(58) Field of Classification Search
CPC ..... B41J 11/00; B41J 11/0035; B41J 11/0045; B41J 11/0005; B41J 11/006; B41J 11/0095; B41J 13/0036; B41J 13/0063; B41J 13/106; B41J 13/16
See application file for complete search history.

(56) References Cited

U.S. PATENT DOCUMENTS

2022/0057739 A1* 2/2022 Shibayama ..... G03G 15/6552

FOREIGN PATENT DOCUMENTS

JP 2015066684 A * 4/2015
JP 2018-090378 A 6/2018
JP 2022035688 A * 3/2022 ..... B65H 43/00

OTHER PUBLICATIONS

2022, JP-2022035688-A-MachineTranslation, Shibayama (Year: 2022).*
2015, MachineTranslationofJP-2015066684-A, Yoshii (Year: 2015).*

* cited by examiner

*Primary Examiner* — Scott A Richmond
(74) *Attorney, Agent, or Firm* — Workman Nydegger

(57) ABSTRACT

A recording apparatus includes a recording unit configured to perform recording on a medium, a sheet ejection unit configured to eject the medium after the recording, a loading unit configured to load the ejected medium, a first contact member configured to make contact with a position of an upstream end of the medium in an ejection direction and operate in conjunction with a displacement of a load amount of the medium, a second contact member configured to make contact with a downstream position of the medium in the ejection direction with respect to the first contact member and operate in conjunction with the displacement of the load amount of the medium, one detection auxiliary member configured to make a displacement in conjunction with a displacement of the first contact member and the second contact member, and a detection unit configured to detect the displacement of the detection auxiliary member.

10 Claims, 10 Drawing Sheets

RECORDING APPARATUS AND MEDIUM HOUSING APPARATUS

The present application is based on, and claims priority from JP Application Serial Number 2020-143305, filed Aug. 27, 2020, the disclosure of which is hereby incorporated by reference herein in its entirety.

BACKGROUND

1. Technical Field

The present disclosure relates to a recording apparatus and a medium housing apparatus.

2. Related Art

In the related art, a printing apparatus that performs printing on a roll sheet is known. JP-A-2018-090378 discloses a recording apparatus (printing apparatus) in which a detection unit detects the height of a loaded medium at a position on an upper side of a stacker immediately downstream of a sheet ejection unit.

In JP-A-2018-090378, when a center portion of an ejected medium in the conveyance direction protrudes downward in a side view in the ejection direction, it can be detected before the loaded medium is pushed out. However, when a center portion of an ejected medium in the conveyance direction protrudes upward and rises at a position downstream of the detection unit, the height of the loaded medium cannot be properly detected. In this case, loading cannot be properly performed due to pushing out of a previously loaded medium by the ejected medium, buckling of the ejected medium due to collision with a previously loaded medium, and the like.

SUMMARY

A recording apparatus includes a recording unit configured to perform recording on a medium having a sheet shape, a sheet ejection unit configured to eject the medium after the recording, a loading unit including a loading surface on which the medium, after being ejected, is loaded, a first contact member configured to make contact with a position of an upstream end of the medium in an ejection direction and operate in conjunction with a displacement of a load amount of the medium, a second contact member configured to make contact with a downstream position of the medium in the ejection direction with respect to the first contact member and operate in conjunction with the displacement of the load amount of the medium, one detection auxiliary member configured to make a displacement in conjunction with a displacement of the first contact member and the second contact member, and a detection unit configured to detect the displacement of the detection auxiliary member.

A medium housing apparatus includes a loading unit including a loading surface on which the medium, after being ejected, is loaded, a first contact member configured to make contact with a position of an upstream end of the medium in an ejection direction and operate in conjunction with a displacement of a load amount of the medium, a second contact member configured to make contact with a downstream position of the medium in the ejection direction with respect to the first contact member and operate in conjunction with the displacement of the load amount of the medium, one detection auxiliary member configured to make a displacement in conjunction with a displacement of the first contact member and the second contact member, and a detection unit configured to detect the displacement of the detection auxiliary member.

DESCRIPTION OF EXEMPLARY EMBODIMENTS

1. Embodiment

A schematic configuration of a recording apparatus 1 according to an embodiment is described below.

Figure 1:
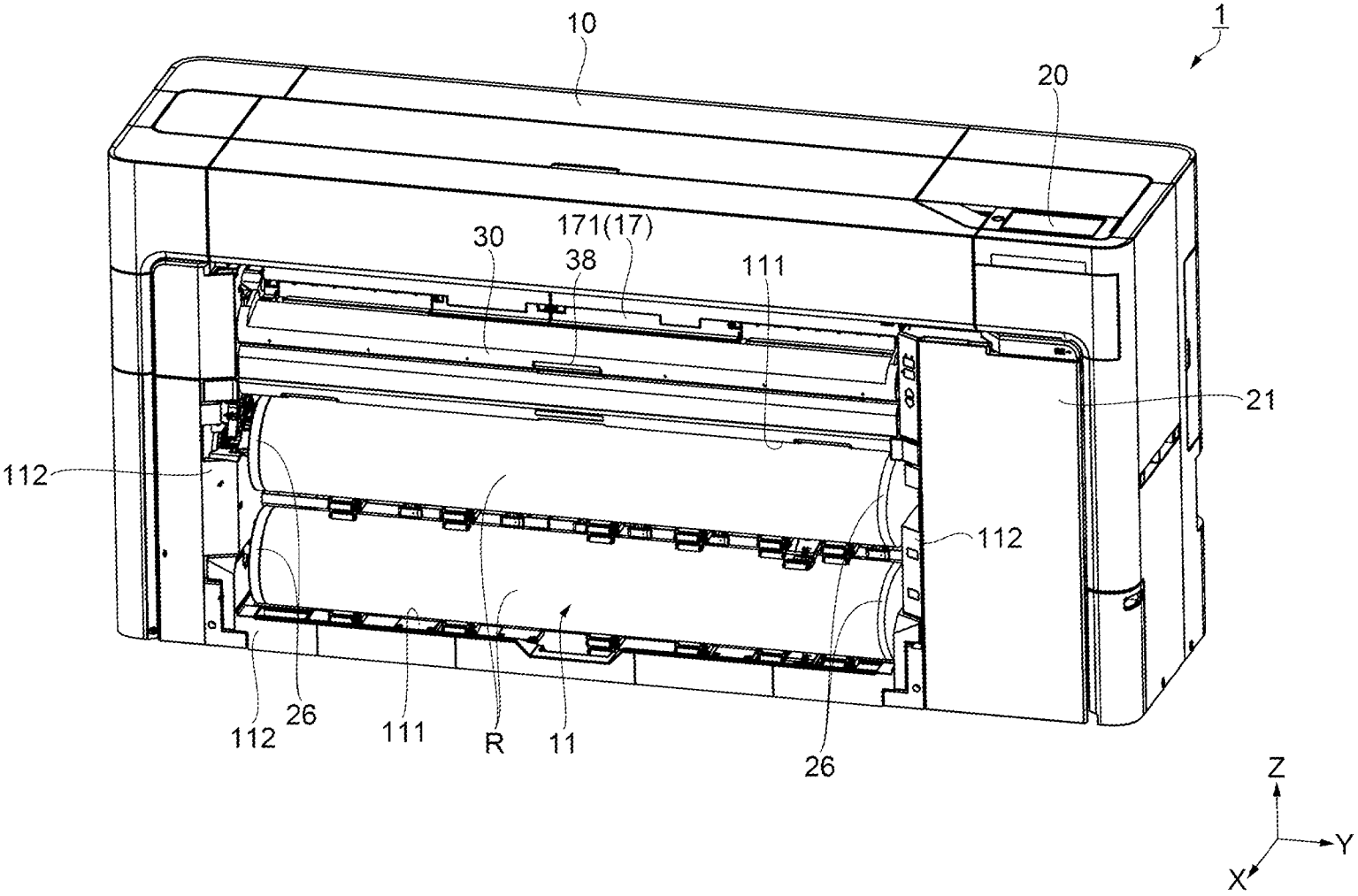
FIG. 1 is a perspective view of a recording apparatus according to an embodiment as viewed from a front side.
Figure 2:
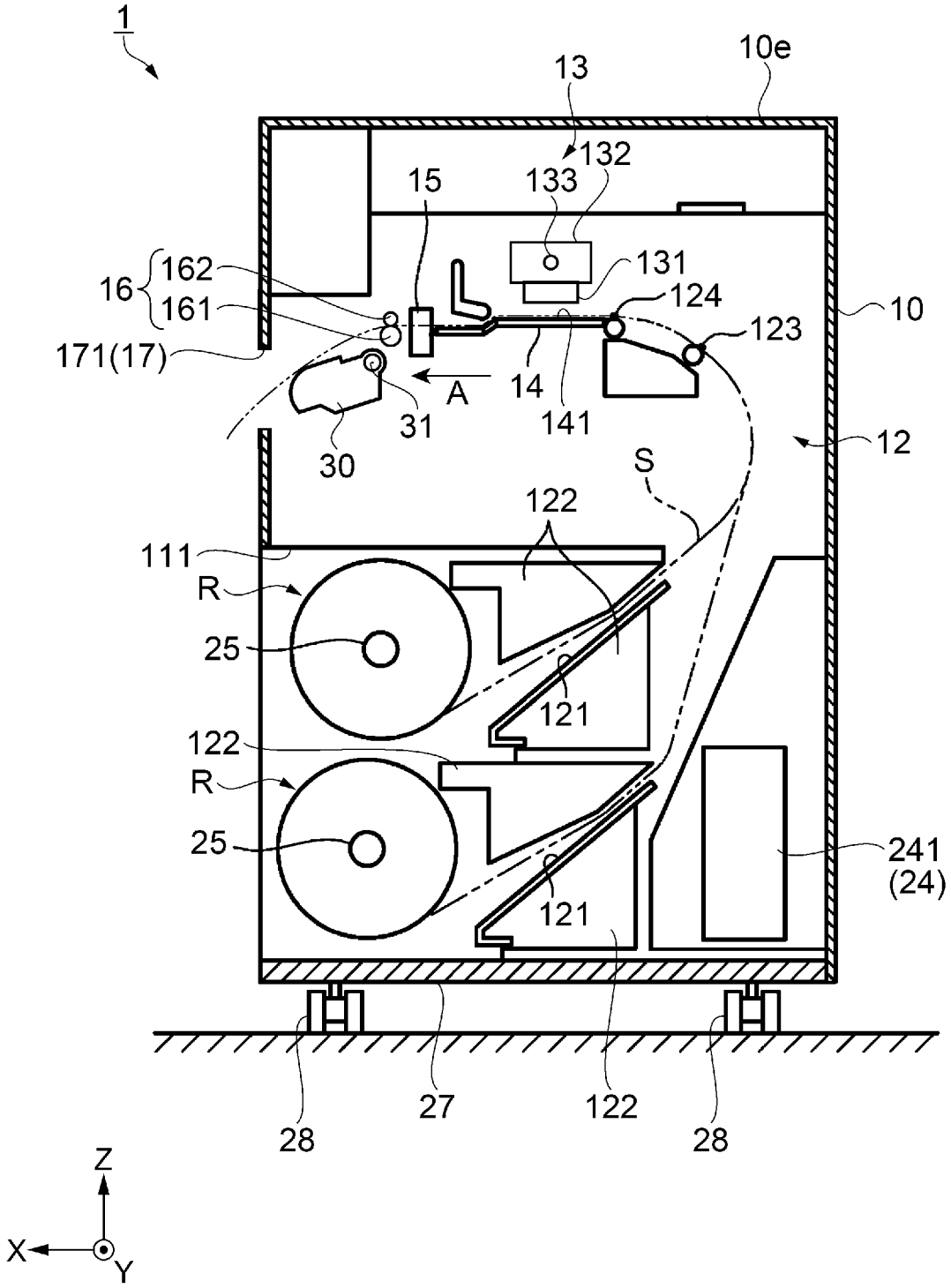
FIG. 2 is a schematic sectional view illustrating a configuration of the recording apparatus.

The recording apparatus 1 of the present embodiment is an ink-jet recording apparatus that performs recording (printing) by discharging ink as a liquid to a medium (sheet) that is a roll-shaped long medium. In addition, as illustrated in FIG. 1 and FIG. 2, the recording apparatus 1 uses a roll sheet R having a cylindrical shape in which a long medium S as a medium is wound in a roll shape around a cylindrical core member 25. The recording apparatus 1 of the present embodiment is a recording apparatus for large media that performs printing on the long medium S with a short side width of A3 (297 mm) or greater.

Specifically, there are a plurality of types of the long medium S that constitutes the roll sheet R. For example, long media S with high bending rigidity such as photographic paper, and long media S with lower bending rigidity than photographic paper, such as plain paper, are used. Also, there are a plurality of sizes of long media S. For example, long media S of A0 size to A3 size are used. In addition, the recording apparatus 1 of the present embodiment can perform recording not only with the roll sheet R as the recording medium, but also with rectangular single sheet paper, cardboard, and the like cut in a fixed size, by supplying the aforementioned into a housing 10.

In the drawings described below, it is assumed that the recording apparatus 1 is placed on a horizontal plane. In addition, as the directions along the horizontal plane, the front-rear direction of the recording apparatus 1 is defined as the X direction and the left-right direction (or the width direction of the long medium S) orthogonal to the X direction is defined as the Y direction. In addition, the vertical direction (the up and down direction) with respect to the horizontal plane is defined as the Z direction. In addition, the front direction is defined as the +X direction, the rear direction is defined as the −X direction, the right direction is defined as the +Y direction, the left direction is defined as the −Y direction, and the upward direction is defined as the +Z direction, and the downward direction is defined as the −Z direction.

The following describes the recording apparatus 1 that conveys, to a recording unit 13, the long medium S sent out from the roll sheet R, and performs recording on the long medium S in a sheet shape.

As illustrated in FIG. 1 and FIG. 2, the recording apparatus 1 includes the housing 10 having a cuboid shape, and a frame 27 that supports each part of the recording apparatus 1. The housing 10 is coupled with the frame 27. In addition, the frame 27 is supported by a plurality of casters 28 that constitute leg parts.

The recording apparatus 1 includes a housing unit 11 that houses the roll sheet R, a conveyance unit 12 that conveys, to the recording unit 13, the long medium S sent out from the roll sheet R housed in the housing unit 11, and the recording unit 13 that performs recording on the conveyed long medium S in a sheet shape. In addition, the recording apparatus 1 includes a supporting part 14 that is disposed opposite to the recording unit 13 and supports the long medium S, and a cutting part 15 that cuts the recorded long medium S. Here, the long medium S cut into a single sheet medium is referred to as a single sheet medium S1 in the following description.

The recording apparatus 1 includes a sheet ejection unit 17 that ejects the long medium S (the single sheet medium S1) and the like cut at the cutting part 15 to the outside in the front direction of the housing 10. In a conveyance direction A of the long medium S, the recording apparatus 1 includes a guide member 30 that guides the long medium S at a position downstream of the supporting part 14 in the conveyance direction A. The guide member 30 guides the long medium S ejected from the sheet ejection unit 17. Note that in the following description, a downstream position in the conveyance direction A is simply denoted as "downstream". Likewise, an upstream position in the conveyance direction A is simply denoted as "upstream".

The recording apparatus 1 of the present embodiment may cut the long medium S sent out from the roll sheet R after the recording, or may wind up the medium without cutting it. In addition, in the case where recording is performed on single sheet paper, cardboard, or the like, the cutting is not performed. Whether the cutting part 15 is operated or not is controlled based on a request input to an operation panel 20 by the user, an output mode stored in a control unit 24, and the like.

The housing unit 11 includes an opening 111 at an approximate center in the left-right direction on the front side of the housing 10, and a space extending from the front side toward the rear side, and thus the housing unit 11 houses the roll sheet R in a detachable manner. In addition, the housing unit 11 houses two roll sheets R side by side in the height direction on the front side. Each roll sheet R is provided with holding members 26 that rotatably hold the roll sheet R at both end portions. Further, the holding members 26 are held by holding units 112 fixed to the opening 111 in the left-right direction and the downward direction. When driven by a driving unit (omitted in the drawing) into rotation, the holding members 26 rotate the roll sheet R held by the holding members 26 around the central axis of the core member 25.

The holding units 112 are separated into two on the upper side and the lower side for the roll sheet R on the upper side and the roll sheet R on the lower side. The holding unit 112 on the upper side is fixed to the opening 111, and the roll sheet R on the lower side is installed by inserting it to a predetermined position from the front side with the holding members 26 provided thereto. The holding unit 112 on the lower side is formed such that it is movable in the front-rear direction, and the roll sheet R on the lower side is provided in the housing unit 11 by drawing out the holding unit 112 to the front side, inserting the roll sheet R provided with the holding members 26 to a predetermined position in the holding unit 112 from the upper side, and then pushing back the holding unit 112 to the rear side. In addition, each roll sheet R can be removed from the housing unit 11 (the holding unit 112) by performing the reverse of the procedure used to install each one.

The conveyance unit 12 conveys, toward the supporting part 14 (the recording unit 13), the long medium S sent out from the roll sheet R. The conveyance unit 12 includes a conveyance path formation part 122, an intermediate roller pair 123, a conveyance roller pair 124 and the like. The conveyance unit 12 conveys the long medium S to the supporting part 14 through a conveyance path 121 and conveys it over a support surface 141 serving as the top surface of the supporting part 14 toward the sheet ejection unit 17 by driving the intermediate roller pair 123 and the conveyance roller pair 124 into rotation by the forward drive of the drive motor (omitted in the drawing). Note that FIG. 2 illustrates a state where the long medium S is sent out from both of the two roll sheets R; however, the long medium S is sent out from one roll sheet R during actual printing.

As illustrated in FIG. 2, the recording unit 13 performs recording (printing) on the long medium S. The recording unit 13 includes a head 131 that discharges ink toward the long medium S, a carriage 132 on which the head 131 is mounted, and a guide rail 133 disposed along the width direction. In addition, the recording unit 13 includes a movement mechanism (omitted in the drawing) that moves the carriage 132 back and forth along the guide rail 133. Note that the supporting part 14 that supports the long medium S at the support surface 141 is disposed at a position opposite to the head 131. Together with the carriage 132, the head 131 performs recording on the long medium S supported by the supporting part 14 by discharging ink while moving back and forth in the width direction of the long medium S.

The recording apparatus 1 includes the cutting part 15, an ejection roller pair 16, and the guide member 30 at a position downstream of the long medium S with respect to the supporting part 14. The supporting part 14 (the support surface 141), facing the region where the head 131 of the recording unit 13 moves back and forth, is formed to extend in the left-right direction and the front-rear direction, and also extend to the vicinity of the cutting part 15 provided on the downstream side.

As illustrated in FIG. 2, the cutting part 15 cuts the long medium S for which recording has been completed. The cutting part 15 is located closer to the rear surface side than the sheet ejection unit 17 and closer to the front surface side than the recording unit 13. The cutting part 15 cuts the long medium S across the width direction at a cutting position by moving a cutting blade (omitted in the drawing) back and forth in the width direction (left-right direction).

The ejection roller pair 16 is provided at a position downstream of the cutting part 15. The ejection roller pair 16 is composed of a driving roller 161 for driving, and a driven roller 162 that rotates to follow the rotation of the driving roller 161. When ejecting a medium, the ejection roller pair 16 sandwiches the medium between the driving roller 161 and the driven roller 162.

The guide member 30 is provided at a position immediately downstream of the ejection roller pair 16. The guide member 30 supports the long medium S that has passed through the supporting part 14, and guides the long medium S to the sheet ejection unit 17. The guide member 30, which constitutes the sheet ejection unit 17, is exposed on the front side of the housing 10. Note that by driving the ejection roller pair 16 into rotation by the forward drive of the drive motor (omitted in the drawing), the long medium S is guided by the guide member 30 and ejected from an outlet 171 of the sheet ejection unit 17.

An ink cover 21 is turnably provided on the right front side of the housing unit 11 (the opening 111) of the housing 10. The ink cover 21 is configured such that its interior is exposed when the right end side is turned to the front side around a turning shaft (omitted in the drawing) provided in the up and down direction on the left end side. When the right end side of the ink cover 21 is turned to the front side, a cartridge holder where an ink cartridge that houses ink as an example of a liquid is detachably provided is exposed (the cartridge holder and the ink cartridge being omitted in the drawing). In this state, the user can replace the ink cartridge from the front side of the recording apparatus 1.

The operation panel 20 where an operation instruction to the recording apparatus 1 can be made is provided in a front right end portion in a top surface 10*e* of the housing 10. The operation panel 20 has a tilt mechanism (omitted in the drawing), and therefore can be used by tilting the operation panel 20 to a position where the operation panel 20 is easy to operate. The user can provide an operation instruction such as an output mode to the recording apparatus 1 from the front side.

The recording apparatus 1 includes the control unit 24. The control unit 24 is formed as an electric circuit composed of a plurality of electronic components. The control unit 24 is configured in a circuit board 241 provided in a rear lower portion of the housing 10. The control unit 24 is electrically coupled with the operation panel 20, and performs control of the recording apparatus 1 based on an operation instruction input by the user. The control unit 24 generally controls an operation of each part that constitutes the recording apparatus 1. The control unit 24 can display and/or notify information to the user through the operation panel 20, which also serves as a display unit, and through an indicator (omitted in the drawing), a sound notification unit (omitted in the drawing), and the like. In the present embodiment, the control unit 24 specifically controls the medium ejection operation.

A configuration of the guide member 30 is described below.

As described above, the guide member 30 is provided at a position immediately downstream of the ejection roller pair 16, and guides the long medium S to the sheet ejection unit 17. The guide member 30 of the present embodiment includes a turning shaft 31 on the upstream side, and can be displaced (rotated) to three positions around the turning shaft 31.

Figure 3:
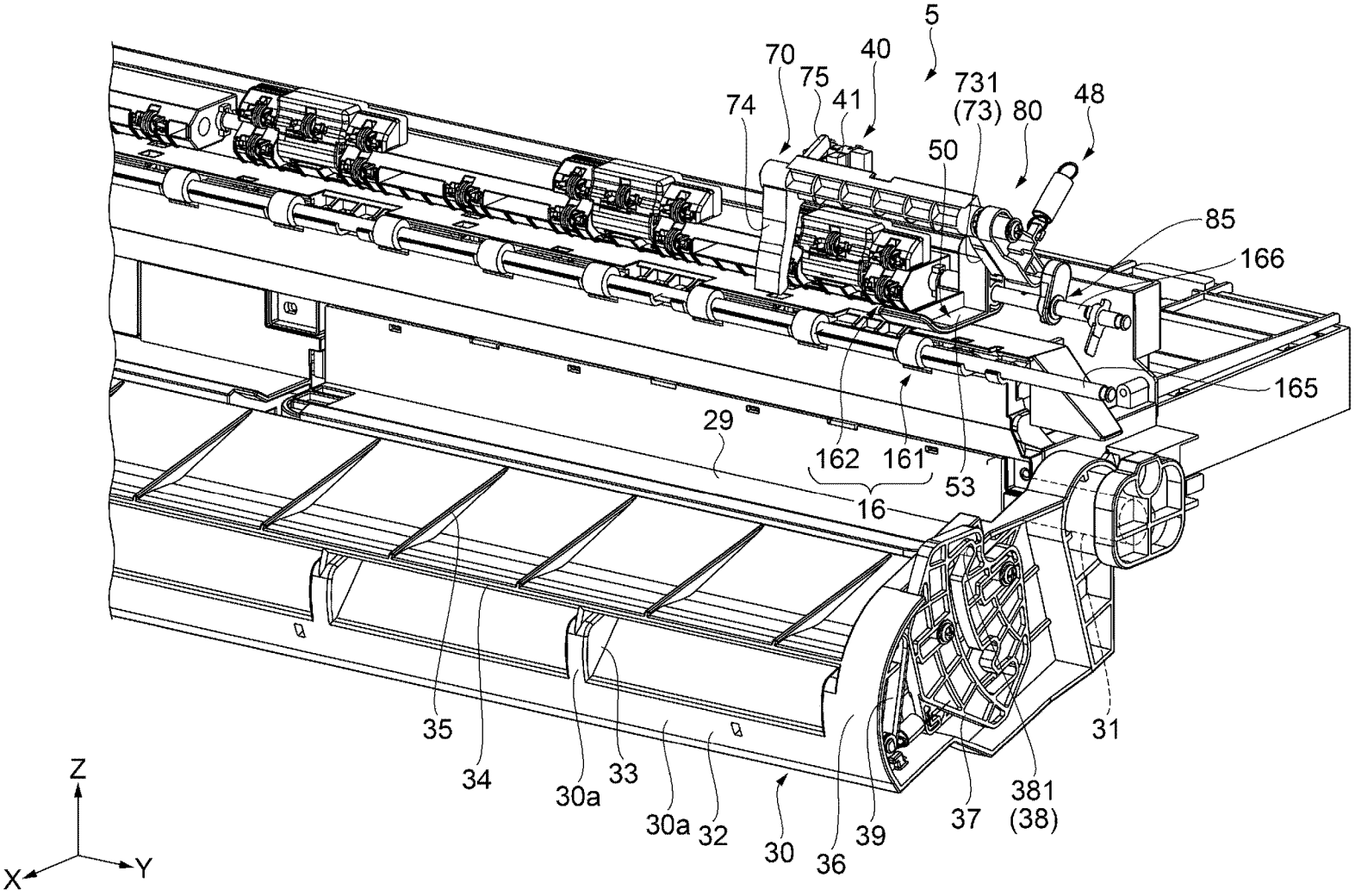
FIG. 3 is a perspective view illustrating a load detection mechanism that detects the height of a loaded medium.

FIG. 3 is a perspective view illustrating a load detection mechanism 5 that detects the height of the medium loaded in a stacker 90 serving as a medium housing apparatus described later (see FIG. 10), and is a perspective view of the load detection mechanism 5 as viewed from a right front side. In addition, FIG. 3 is a schematic perspective view illustrating a position of the guide member 30 in a case where the load detection mechanism 5 operates.

The position of the guide member 30 when the present disclosure is implemented is a first supporting position, which is the position illustrated in FIG. 3. When located at the first supporting position, the guide member 30 supports the single sheet medium S1 ejected in the direction downward of the position where the supporting part 14 supports the medium, and the guide member 30 guides the medium to the stacker 90.

As illustrated in FIG. 3, the guide member 30 is formed along the width direction with the same width size as that of the outlet 171. At the front surface, the guide member 30 includes a first guide part 32 having a curved surface formed with a predetermined curvature in a side view, and the curved surface is contiguous across the width direction. On the upper side of the first guide part 32, a plurality of second guide parts 33 are formed at a predetermined pitch across the width direction. The second guide parts 33 are each formed in a rib shape protruded upward in the front-rear direction with an end surface contiguous with the same curved surface as that of the curved surface of the first guide part 32.

A plate-shaped wall part 34 with a gentle recessed shape in a side view is formed across the width direction and the upstream side from the upper end portion of the second guide part 33 contiguous with the curved surface of the first guide part 32. The wall part 34 is tilted downward in a direction toward the upstream side (the rear side). At the top surface of the wall part 34, a plurality of third guide parts 35 are formed at a predetermined pitch across the width direction. The third guide parts 35 are each formed in a rib shape protruding upward in the front-rear direction with a straight end surface. Note that the curved surfaces of the first guide parts 32 and the second guide parts 33 function as a guide surface 30*a* that guides the long medium S being conveyed.

End portions 36 on two sides of the guide member 30 in the width direction each have a curved surface with the same curvature as that of the curved surface (the guide surface 30*a*) of the first guide part 32. The end portions 36 are formed to extend upward from the second guide part 33 in an R-shape in a side view from the front side to the upper side. In addition, as illustrated in FIG. 3, the end portions 36 on the two sides are formed in a state surrounding the turning shaft 31 provided to the frame 27 on the upstream side.

As illustrated in FIG. 3, in each of the end portions 36 on the two sides of the guide member 30, an engaging part 37 is configured as a mechanism for turning the guide member 30 around the turning shaft 31 and displacing the position of the guide member 30 itself. In addition, an engagement reception part 38 (an engagement reception pin 381) that receives the engaging part 37 is fixed to the frame 27. The guide member 30 is positioned at each position (three positions) by being displaced using the engaging part 37 and engaged with the engagement reception part 38 fixed to the frame 27. Note that the mechanism that displaces the guide member 30 is composed of an engagement releasing plate 39 that releases the engagement during displacement and the like, in addition to the engaging part 37 and the engagement reception part 38.

Next, the load detection mechanism 5 that detects the height of the medium loaded in the stacker 90 (see FIG. 10) is described with reference to FIGS. 3 to 10.

Figure 10:
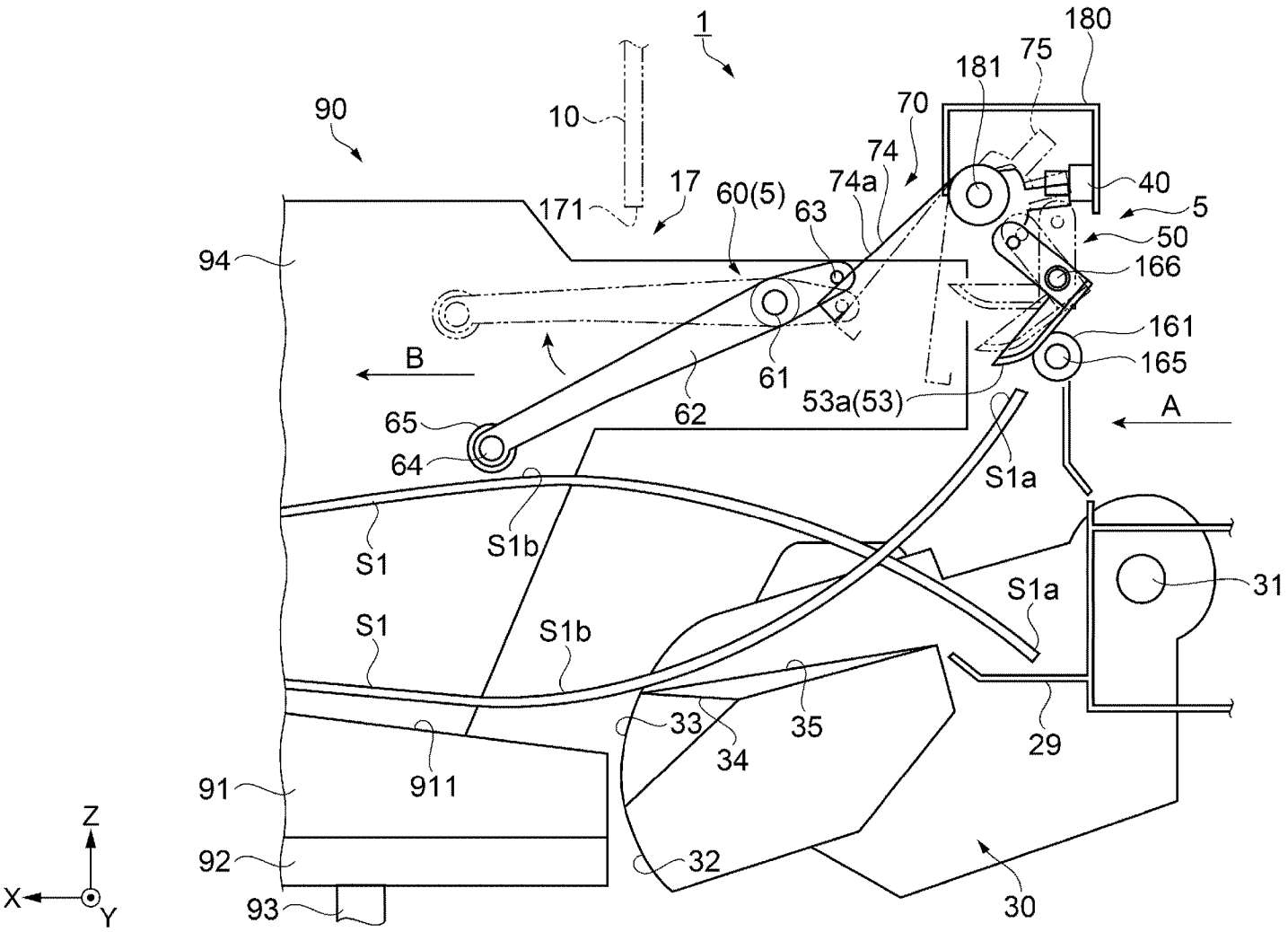
FIG. 10 is a side sectional view including a stacker and the load detection mechanism.

As illustrated in FIG. 10, the load detection mechanism 5 is a mechanism for detecting the load height of the medium (the single sheet medium S1) ejected from the sheet ejection unit 17 and loaded in the stacker 90, and sending the detection result to the control unit 24. Note that when it is detected that the load height of the medium has reached a set height, or in other words, when the control unit 24 determines that the medium height has exceeded a predetermined value, the ejection of the medium or the like is stopped in response to a request of the control unit 24. In this manner, the load amount of the loaded single sheet medium S1 is properly controlled, and defects such as a paper jam are prevented.

As illustrated in FIG. 3, the load detection mechanism 5 is composed of a first contact member 50, a second contact member 60 (see FIG. 10), a detection auxiliary member 70, a transmission member 80, an activation member 85, a detection unit 40 and the like. Note that as illustrated in FIG. 10, the second contact member 60 is configured in the stacker 90 that loads the ejected medium as a member separated from the recording apparatus 1.

The load detection mechanism 5 provided in the recording apparatus 1, except for the second contact member 60, is described below.

First, the ejection roller pair 16 of the present embodiment is described.

As its specification, the recording apparatus 1 of the present embodiment has an output mode in which a medium such as single sheet paper or cardboard is inserted from the outlet 171 of the sheet ejection unit 17, or more specifically, from a gap between the outlet 171 and the guide member 30 in a direction opposite to the conveyance direction A, conveyed and supplied toward the recording unit 13, recorded at the recording unit 13, and ejected from the outlet 171.

In this case, in the case where the ejection roller pair 16 is in a positional relationship that nips the medium, the single sheet paper cannot be supplied from the outlet 171 toward the recording unit 13. Therefore, as illustrated in FIG. 3, the driven roller 162 is provided with a second turning shaft 166 and configured to separate the driven roller 162 away from the driving roller 161 by driving the second turning shaft 166 into rotation. Note that the shaft for driving the driving roller 161 into rotation is a first turning shaft 165.

In the case where the single sheet medium S1 (or the long medium S before it is cut) of the present embodiment is ejected in an ejection direction B (see FIG. 10) to eject it to the stacker 90, the spacing between the driving roller 161 and the driven roller 162 is eliminated by rotating the second turning shaft 166, the single sheet medium S1 is nipped with the driving roller 161 and the driven roller 162, and it is ejected with the rotation of the driving roller 161 (the rotation of the first turning shaft 165). As such, in the recording apparatus 1, the initial position (initial state) of the ejection roller pair 16 is a state where the driven roller 162 is separated from the driving roller 161 as illustrated in FIG. 3. In this state, the load detection mechanism 5 is located at the open position described later.

One load detection mechanism 5 of the present embodiment is provided at a right end portion of the guide member 30 in top plan view. Specifically, the load detection mechanism 5 is provided near the right end portion 36 of the guide member 30 on the inside of the end portion 36 and on a substantially upper side of the driving roller 161 (the first turning shaft 165) that constitutes the ejection roller pair 16.

Note that in the recording apparatus 1 of the present embodiment, a plurality of types of medium with different lengths in the width direction can be used, and the reference in the width direction for conveying the medium is set to one end portion side in the width direction of the medium, which is a right end portion side in the present embodiment. Thus, even in the case where a plurality of types of medium with different width sizes are used, the detection can be achieved by providing the load detection mechanism 5 at one location as the reference position.

In other words, the first contact member 50 and the second contact member 60 are disposed at one end portion side (in the present embodiment right end portion side) in the width direction intersecting the ejection direction B. In addition, in a loading unit 91 (see FIG. 10), the ejected medium is moved toward one end portion side (in the present embodiment, the right end portion side) in the width direction intersecting the ejection direction B while being ejected.

The load detection mechanism 5, except for the second contact member 60 of the present embodiment, has an open position and a detection position as basic positions for maintaining the displacement. Note that the second contact member 60 has the detection position as the basic position. In the first contact member 50, the open position is a position where, with the first contact member 50 raised by rotating it about the second turning shaft 166, the movement path of a medium ejected from the outlet 171 or a medium inserted from the outlet 171 is not blocked, as an initial position in the recording apparatus 1. In addition, in the first contact member 50, the detection position is a reference position for detecting the load amount (height) of the medium ejected to the stacker 90, and a position where the medium is waiting to be ejected to the stacker 90. In this case, the ejection roller pair 16 is driven with the medium sandwiched therebetween.

Now, the drawings of FIG. 4 to FIG. 10 will be described below.

Figure 4:
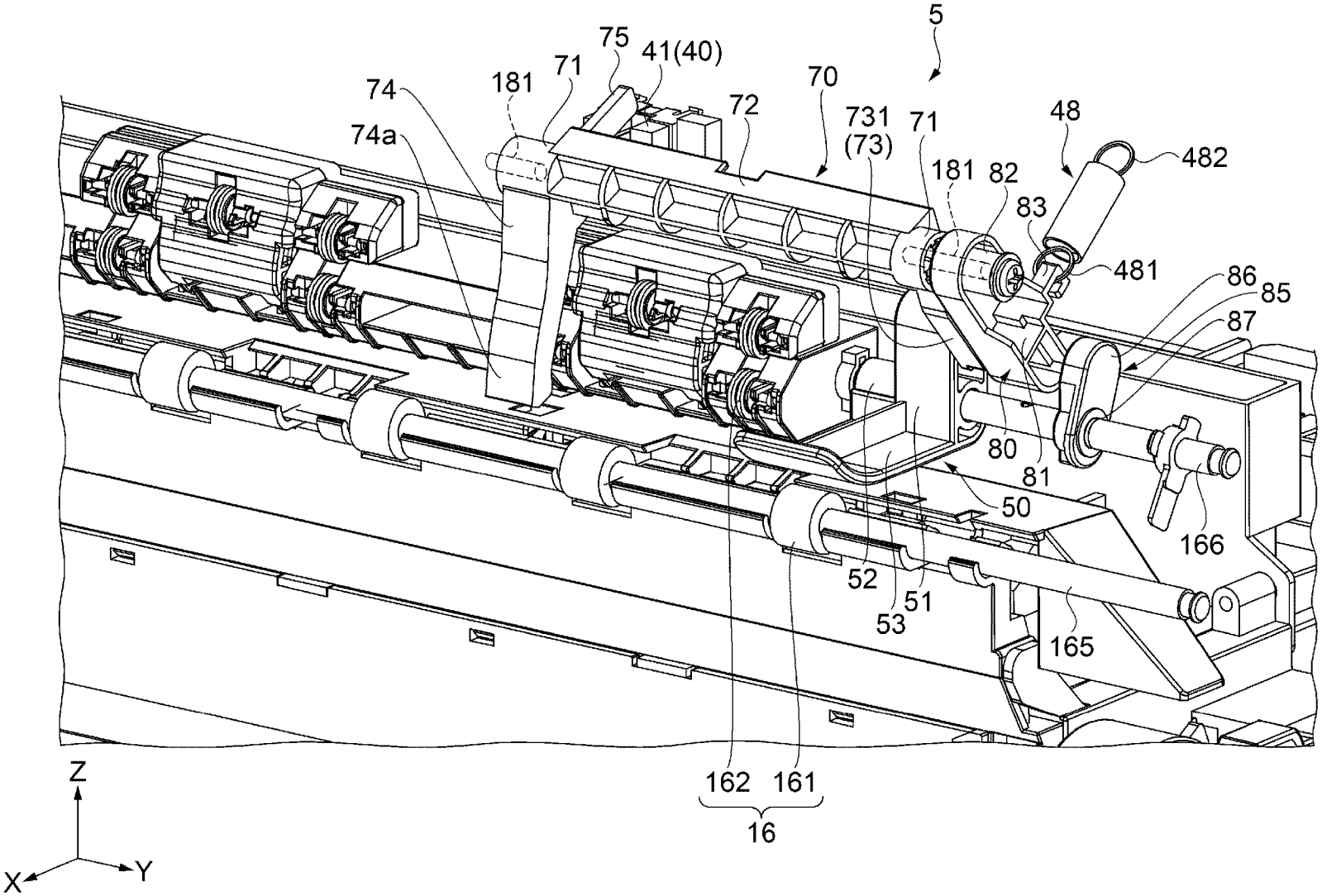
FIG. 4 is a perspective view of a state where the load detection mechanism is located at an open position as viewed from a front side.
Figure 5:
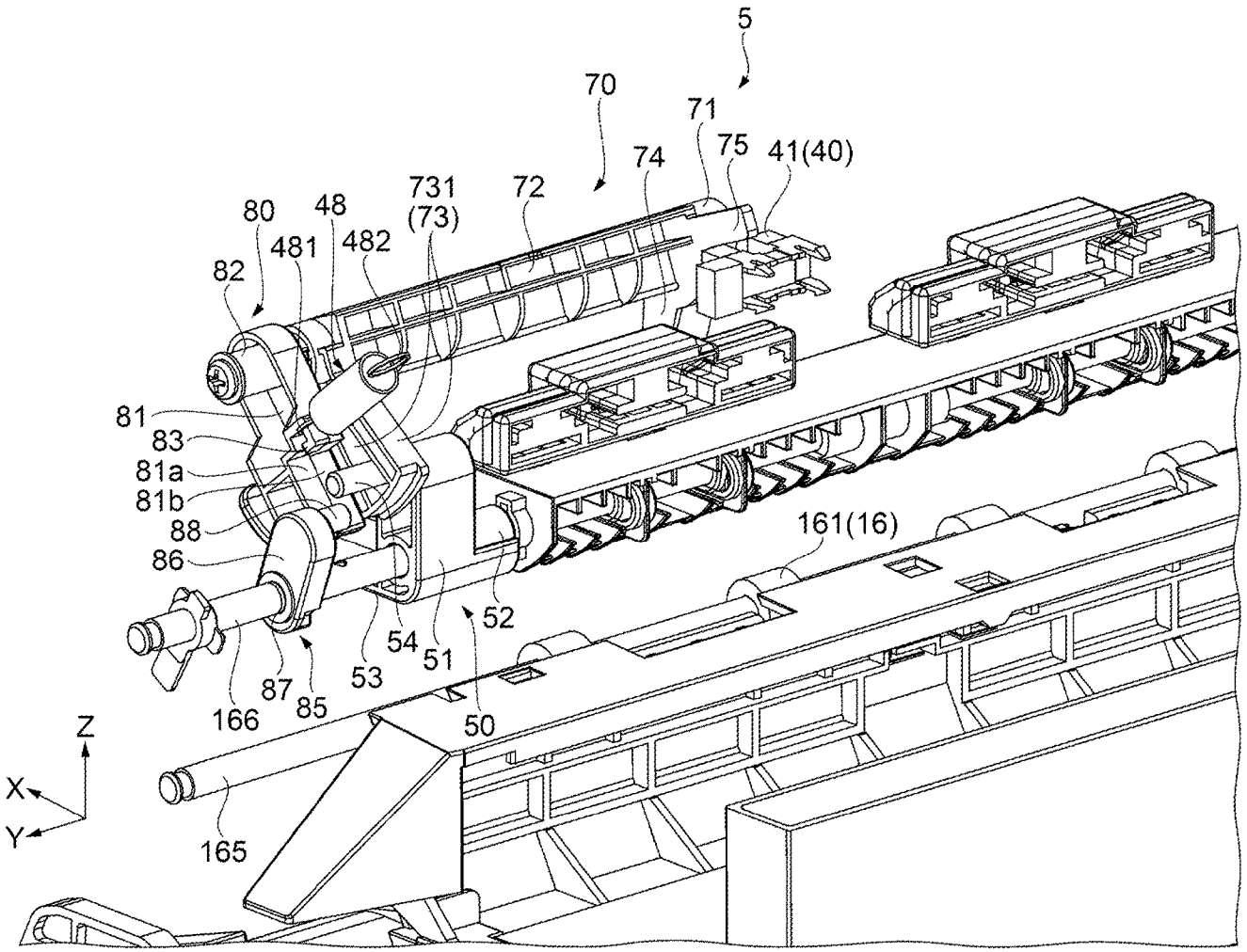
FIG. 5 is a perspective view of a state where the load detection mechanism is located at the open position as viewed from a rear side.
Figure 6:
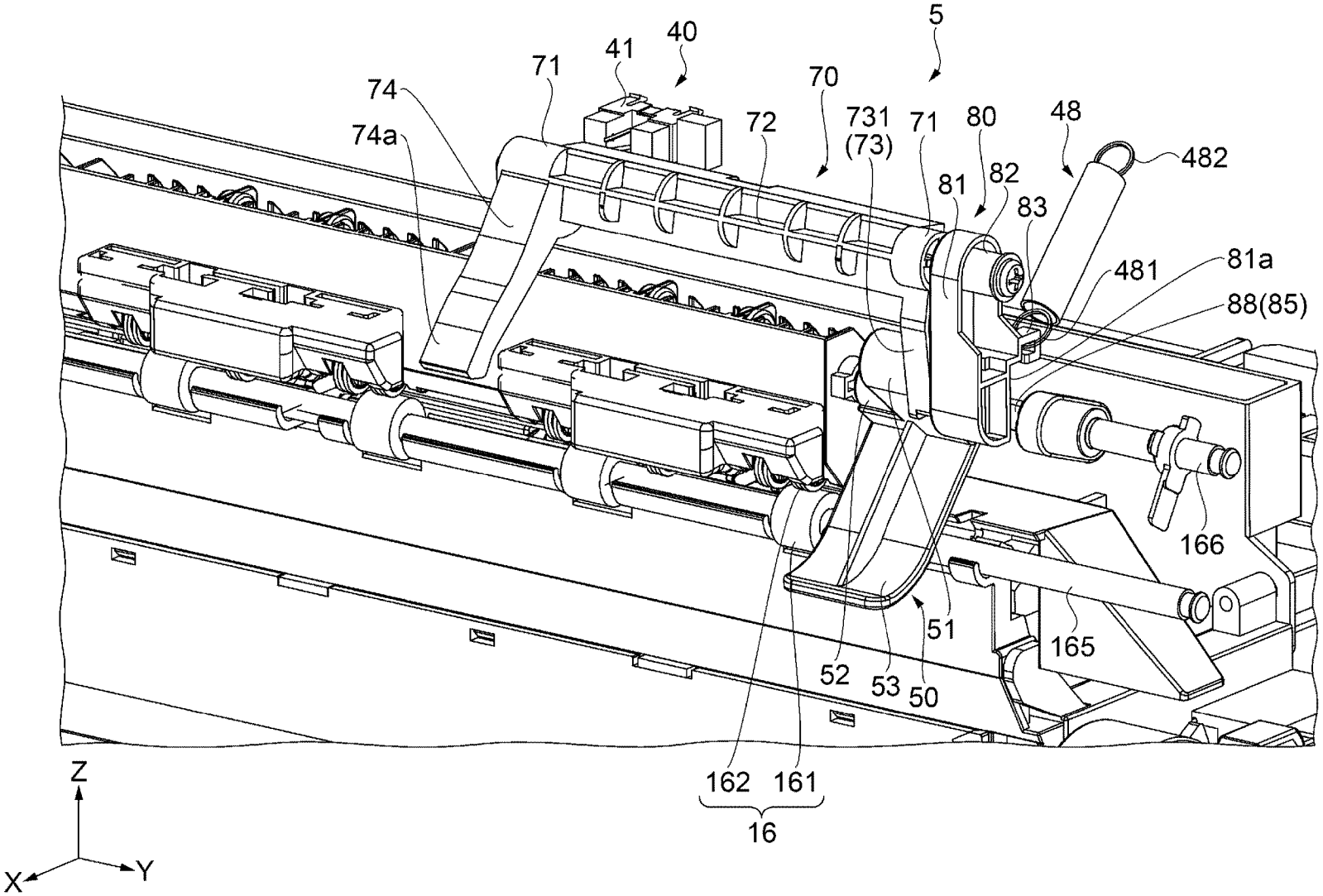
FIG. 6 is a perspective view of a state where the load detection mechanism is located at a detection position as viewed from a front side.
Figure 7:
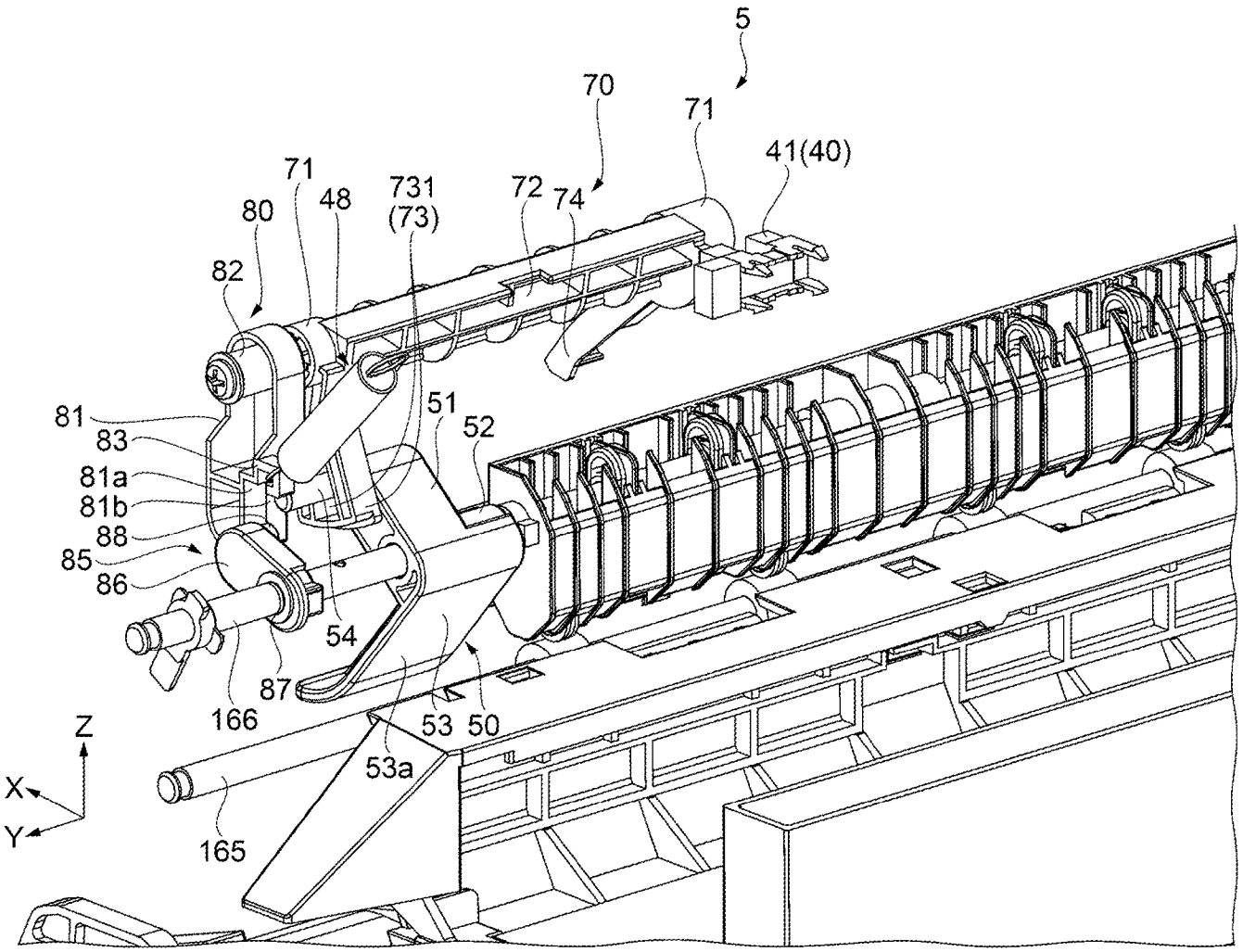
FIG. 7 is a perspective view of a state where the load detection mechanism is located at the detection position as viewed from a rear side.
Figure 8:
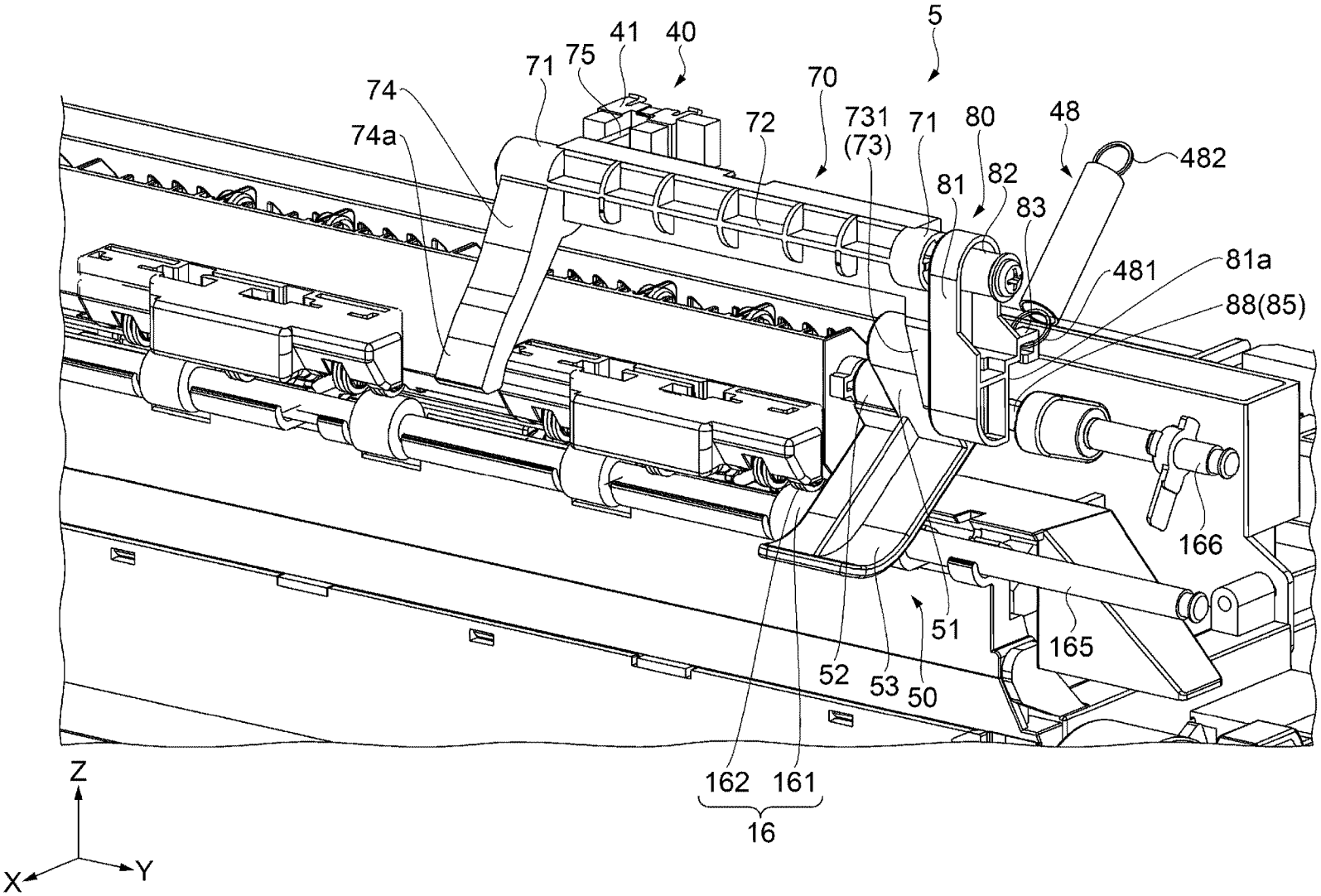
FIG. 8 is a perspective view of a state where the load detection mechanism is located at a detection confirmation position as viewed from a front side.
Figure 9:
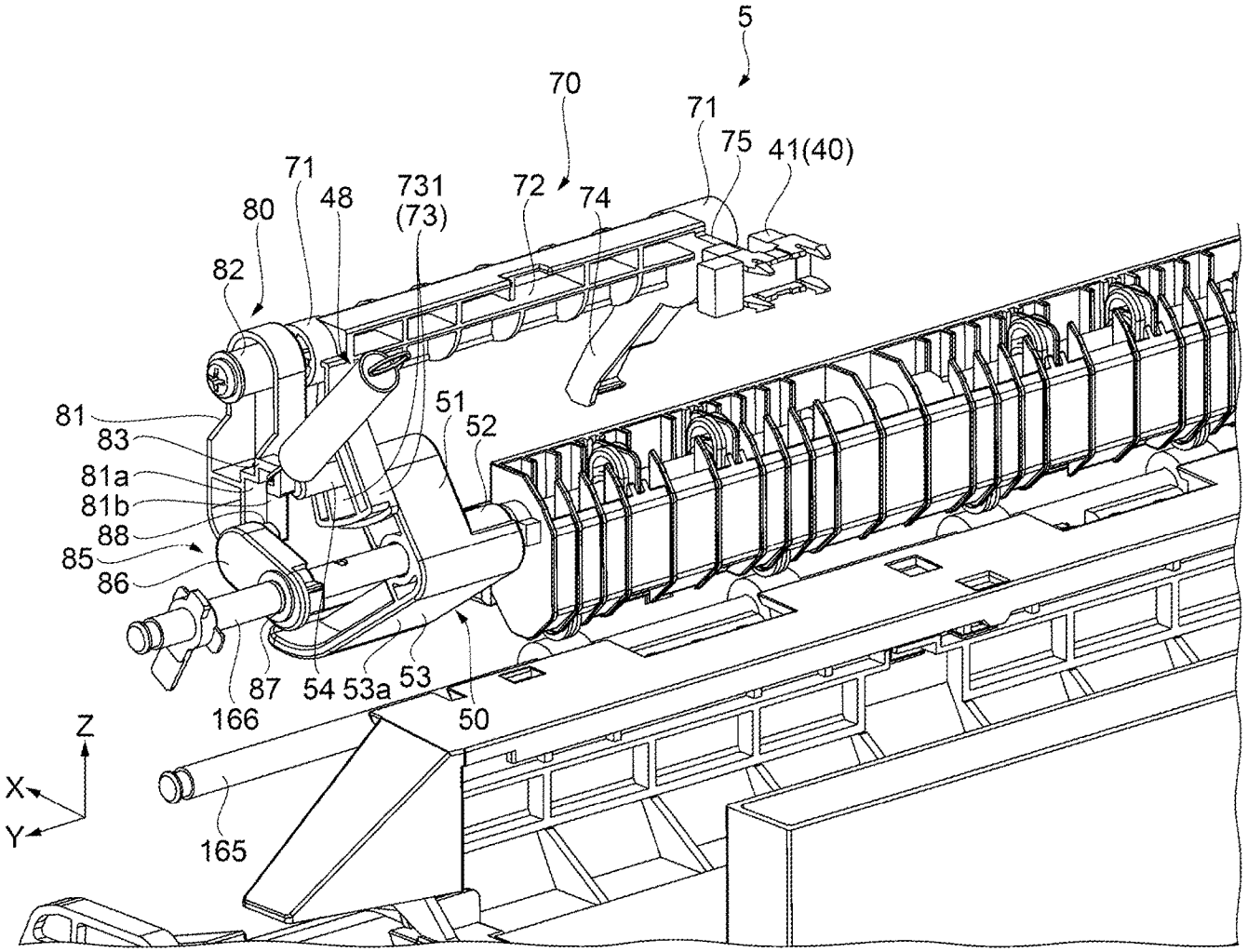
FIG. 9 is a perspective view of a state where the load detection mechanism is located at the detection confirmation position as viewed from a rear side.

FIG. 4 and FIG. 5 illustrate the load detection mechanism 5 at the open position. FIG. 6 and FIG. 7 illustrate the load detection mechanism 5 at the detection position. In addition, FIG. 8 and FIG. 9 illustrate a state of the load detection mechanism 5 at a position where it determines that a medium is detected after it is moved to the detection position. Note that the position where the load detection mechanism 5 determines that a medium is detected is referred to as a detection confirmation position in the following description. FIG. 10 is a diagram for describing an operation of the load detection mechanism 5 in the case where the stacker 90 is attached to the recording apparatus 1.

As illustrated in FIG. 10, the second contact member 60 provided in the stacker 90 and constituting the load detection mechanism 5 is located at the detection position when the load detection mechanism 5, except for the second contact member 60, is located at the open position and the detection position. In addition, FIG. 10 also illustrates a state where the second contact member 60 is at a position where it is determined that a medium is detected (detection confirmation position).

As illustrated in FIG. 3 to FIG. 5, the activation member 85 is a member fixed to the second turning shaft 166, and is rotated in accordance with an operation of bringing the driven roller 162 into contact with the driving roller 161 with a rotation of the second turning shaft 166, so as to transmit the rotation to the transmission member 80. The activation member 85 includes a main body 86 formed in a track shape in a right side view, and is fitted to the second turning shaft 166 by providing one end portion of the activation member 85 with a fit hole 87 that fits to the second turning shaft 166. In addition, at the other end portion of the activation member 85, a protruding part 88 with a columnar shape protruding toward the transmission member 80 provided on the left side is provided.

The transmission member 80 is a member provided on the left side of the activation member 85, and is rotated by being transmitted the rotation of the activation member 85. Note that the transmission member 80 is pulled diagonally upward and backward by a coil spring 48 at all times. The transmission member 80 includes a main body 81 formed in a box shape and is substantially track-shaped in a right side view, and has a turning part 82 cylindrically protruding rightward at an end portion on the upper side. The turning part 82 makes the transmission member 80 turnable with respect to a third turning shaft 181 (see FIG. 10; indicated with the broken line in FIG. 4).

The transmission member 80 includes a spring fixing part 83 that fixes one end portion 481 of the coil spring 48 to a center portion of a rear side surface of the main body 81, which has a track shape. In addition, the protruding part 88 of the activation member 85 makes contact with a right side surface 81*a* on the lower side of the rear side surface where the spring fixing part 83 is formed, and a protruding part 54 of the first contact member 50 described later makes contact with a left side surface 81*b*.

Note that the third turning shaft 181 rotatably pivotally supports the turning part 82 of the transmission member 80, and also turnably pivotally supports a turning part 71 extending in the left-right direction of the detection auxiliary member 70 described later. In the present embodiment, the third turning shaft 181 is provided in a holding member 180 (see FIG. 10) provided on the upper side of the detection auxiliary member 70. With the third turning shaft 181, the holding member 180 pivotally supports the transmission member 80 and the detection auxiliary member 70, and holds each member including the detection unit 40 at a predetermined position. In addition, the holding member 180 fixes the other end portion 482 of the coil spring 48 described later.

The first contact member 50 is a member that rotates around the second turning shaft 166 in contact with an ejected medium, and transmits its displacement to the detection auxiliary member 70. The first contact member 50 includes a main body 51 formed in an L-shape in a right side view. The first contact member 50 includes a turning part 52 that cylindrically extends in the left-right direction and makes the first contact member 50 turnable with respect to the second turning shaft 166.

The first contact member 50 includes a contact part 53 that extends downstream in a tongue shape from the turning part 52 and makes contact with an ejected medium. In other words, the turning part 52 (the second turning shaft 166) is disposed upstream of the contact part 53 in the ejection direction B (see FIG. 10). In addition, the first contact member 50 includes the protruding part 54 protruding rightward in a columnar shape, at the upper end portion of the main body 51 extending in a substantially vertical direction from the turning part 52 with respect to the contact part 53. Note that the protruding part 54 makes contact with the side surface 81*b* of the transmission member 80.

The detection auxiliary member 70 is a member that turns in conjunction with the turning of one of the first contact member 50 and the second contact member 60, and transmits the displacement due to the turning to the detection unit 40. The detection auxiliary member 70 includes the turning part 71 pivotally supported by the third turning shaft 181 in a turnable manner and forming the end portions in the left-right direction, and a joint part 72 that couples the left and right turning parts 71.

The detection auxiliary member 70 includes a first contacting part 73 formed at the turning part 71 of the right end portion, and a second contacting part 74 formed at the turning part 71 of the left end portion. In addition, the detection auxiliary member 70 includes a light shielding plate 75 as a plate-shaped detection object part protruding rearward in the turning part 71 of the left end portion.

The first contacting part 73 is a portion where the first contact member 50 makes contact. The first contacting part 73 includes plate-shaped sandwiching plates 731 formed to extend downward from the turning part 71 of the right end portion, and, in a right side view, extend in two directions with a predetermined angle with the turning part 71 at the center. As illustrated in FIG. 5, the sandwiching plates 731 slidably sandwich the rightward protruding part 54 of the first contact member 50, which is provided on the left side of the sandwiching plates 731, between the two sandwiching plates 731. In other words, the protruding part 54 of the first contact member 50 makes contact with the sandwiching plates 731.

The second contacting part 74 is a portion where the second contact member 60 makes contact. The second contacting part 74 is formed in a plate shape extending downward from the left end portion of the turning part 71. The second contacting part 74 includes a contact surface 74*a* on the front side. The contact surface 74*a* slidably receives a protruding part 63 of the second contact member 60 (described later) provided in the stacker 90. Accordingly, the protruding part 63 of the second contact member 60 makes contact with the contact surface 74*a* of the second contacting part 74.

The first contact member 50 makes contact with the first contacting part 73 of the detection auxiliary member 70, and the second contact member 60 makes contact with the second contacting part 74 of the detection auxiliary member 70. In addition, with the joint part 72, the first contacting part 73 and the second contacting part 74 are spaced away from each other in top plan view. Therefore, the first contact member 50 and the second contact member 60 do not overlap in top plan view, and do not make contact with each other.

The light shielding plate 75 functions as a to-be-detected part to be detected by the detection unit 40 described later. The light shielding plate 75 is displaced by the rotation of the turning part 71 by either the first contacting part 73 or the second contacting part 74, and blocks light of a detection sensor provided in the detection unit 40.

The detection unit 40 includes a sensor that turns ON/OFF in accordance with displacement of the light shielding plate 75 of the detection auxiliary member 70. In the present embodiment, in the detection unit 40, an optical sensor 41 is provided so as to sandwich the light shielding plate 75 in the left-right direction. The optical sensor 41 performs detection by, for example, turning "OFF" when light emitted from the light emission part can be received at a reception part (when light is not blocked), and turning "ON" when the light is blocked and cannot be received. Accordingly, the detection unit 40 switches ON/OFF depending on whether the light shielding plate 75 has blocked the light emitted by the optical sensor 41.

With reference to FIG. 4 and FIG. 5, a case where the load detection mechanism 5 moves (displaces) from the detection position to the open position is described below.

First, when the second turning shaft 166 rotates clockwise by a predetermined angle in a right side view, the driven roller 162 is separated from contact with the driving roller 161. Through this operation, the activation member 85 fit to the second turning shaft 166 is also driven and rotated clockwise.

Note that with the rearward pulling force of the coil spring 48, the transmission member 80 brings the right side surface 81*a* into sliding contact with the protruding part 88 of the activation member 85 and follows the rotation of the activation member 85, and thus, the transmission member 80 rotates counterclockwise by a predetermined angle around the third turning shaft 181 in a right side view. Through this operation, the transmission member 80 moves to the open position.

In conjunction with the movement to the open position, the transmission member 80 makes sliding contact with the protruding part 54 of the first contact member 50 in contact with the left side surface 81*b*. Then, the protruding part 54 moves to follow the rotation of the transmission member 80, and the first contact member 50 rotates clockwise by a predetermined angle around the second turning shaft 166 in a right side view. Through this operation, the first contact member 50 moves to the open position.

In addition, when the first contact member 50 rotates clockwise around the second turning shaft 166, the sandwiching plates 731 (the first contacting part 73) sandwiching the protruding part 54 are pressed rearward. When the sandwiching plates 731 of the detection auxiliary member 70 are pressed rearward, the detection auxiliary member 70 rotates counterclockwise by a predetermined angle around the third turning shaft 181 (see FIG. 4) in a right side view. Through this operation, the detection auxiliary member 70 moves to the open position. With the movement of the detection auxiliary member 70 to the open position, the light shielding plate 75 also rotates by a predetermined angle. In the present embodiment, the light shielding plate 75 moves out from the position where the light of the optical sensor 41 is blocked, and moves upward.

With reference to FIG. 6 and FIG. 7, a case where the load detection mechanism 5 moves from the open position to the detection position is described below. Note that in FIG. 6, the activation member 85 is omitted.

First, when the second turning shaft 166 rotates counterclockwise by a predetermined angle in a right side view, the driven roller 162 makes contact with the driving roller 161. Through this operation, the activation member 85 fitted to the second turning shaft 166 is also driven and rotated counterclockwise.

When the activation member 85 is rotated counterclockwise, the protruding part 88 of the activation member 85 rotates while pressing the right side surface 81*a* of the transmission member 80 to the front side, against the drag of the coil spring 48. When pressed by the activation member 85 to the front side, the transmission member 80 rotates clockwise by a predetermined angle around the third turning shaft 181 in a right side view. Through this operation, the transmission member 80 moves to the detection position.

When the transmission member 80 is rotated clockwise by the activation member 85, the protruding part 54 makes contact with the side surface 81*b* of the transmission member 80, and the first contact member 50 pushed up to the open position rotates counterclockwise around the second turning shaft 166 in a right side view by its own weight due to the center of gravity located on the front side of the second turning shaft 166, with the protruding part 54 in contact with the side surface 81*b*. Through this operation, the first contact member 50 moves to the detection position.

In addition, when the first contact member 50 rotates counterclockwise around the second turning shaft 166, the sandwiching plates 731 (the first contacting part 73) that sandwich the protruding part 54 are pressed frontward. When the sandwiching plates 731 of the detection auxiliary member 70 are pressed frontward, the detection auxiliary member 70 rotates clockwise by a predetermined angle around the third turning shaft 181 in a right side view. Through this operation, the detection auxiliary member 70 moves to the detection position. With the movement of the detection auxiliary member 70 to the detection position, the light shielding plate 75 also rotates by a predetermined angle. In the present embodiment, the light shielding plate 75 moves out from the position where the light of the optical sensor 41 is blocked, and moves downward.

With reference to FIG. 8 and FIG. 9, a case where the load detection mechanism 5 moves from the detection position to the detection confirmation position is described below. Note that in FIG. 8, the activation member 85 is omitted.

When the first contact member 50 is located at the detection position (FIG. 6 and FIG. 7), the front end portion of the contact part 53 hangs downward with the weight of the first contact member 50. In other words, the contact part 53 of the first contact member 50 is pressed to a loading surface 911 (see FIG. 10) side by the weight of the first contact member 50. Note that the contact part 53 may be pressed to the loading surface 911 side by a pressing member (omitted in the drawing) or the like other than the weight of the first contact member 50.

In this state, when the long medium S sandwiched by the ejection roller pair 16 is ejected, the downstream end portion of the ejected long medium S or the like hits a contact surface 53*a* of the contact part 53, and the end portion of the long medium S moves to the front side against the downward force (pressure force) of the weight of the contact part 53. Along with this movement of the long medium S, the contact part 53 rotates clockwise around the second turning shaft 166 in a right side view.

When the contact part 53 (the first contact member 50) rotates clockwise, the sandwiching plates 731 of the detection auxiliary member 70 that sandwich the protruding part 54 are pressed rearward. When the sandwiching plates 731 (the first contacting part 73) are pressed rearward, the detection auxiliary member 70 rotates counterclockwise around the third turning shaft 181 in a right side view.

With the counterclockwise rotation of the detection auxiliary member 70, the light shielding plate 75 rotates toward an area between the light emission part and the light reception part of the optical sensor 41 from the lower side of the detection unit 40 (the optical sensor 41). In this case, when the contact part 53 of the first contact member 50 is pressed by the long medium S and rotated to the detection confirmation position, the light shielding plate 75 of the detection auxiliary member 70 is located at a position where it blocks the light between the light emission part and the light reception part of the optical sensor 41. Note that in the case where the height of the front end portion or the rear end portion of the long medium S is low or the number of the loaded single sheet media S1 is small, the amount of the rotation of the long medium S rotated by the contact part 53 of the first contact member 50 is small, and the light shielding plate 75 of the detection auxiliary member 70 is not rotated to the position where it blocks the light.

Note that as described later, regarding the detection timing of the detection unit 40, the detection unit 40 performs the detection at the timing when the medium (the single sheet medium S1) is ejected and falls downward toward the loading surface 911 (load auxiliary plate 29) as illustrated in FIG. 10. Therefore, no detection is performed in the state where the long medium S has not yet been cut by the cutting part 15. Even when the first contact member 50 is displaced to the detection confirmation position in this state, no detection is performed. Detection is performed at the timing when the long medium S is cut by the cutting part 15 and the single sheet medium S1 is ejected by the ejection roller pair 16.

With reference to FIG. 10, configurations of the stacker 90 and the second contact member 60 are described below.

The stacker 90 serving as a medium housing apparatus is detachably mounted to the housing 10 at a position downstream of the guide member 30 in the conveyance direction A. In addition, the loading unit 91 of the stacker 90 is provided on the lower side of the first supporting position of the guide member 30, and houses the single sheet medium S1.

The stacker 90 includes the loading unit 91 for sequentially loading the single sheet medium S1 ejected from the sheet ejection unit 17 (ejected from the ejection roller pair 16), a plurality of loading frames 92 that support the loading unit 91, and a leg frame 93 that extends in the height direction and that receives the plurality of loading frames 92. For example, four leg frames 93 are provided. A caster (omitted in the drawing) is attached at a lower end portion of each of the leg frames 93, and thus the stacker 90 can move.

In addition, in the loading unit 91, the loading surface 911 that receives the single sheet medium S1 is configured. The loading surface 911 is configured as a tilted surface that gently rises along the ejection direction B. In the stacker 90, a frame 94 where the second contact member 60 is provided is provided on the upper side of the loading unit 91.

The second contact member 60 provided in the frame 94 constitutes the load detection mechanism 5 described above. The second contact member 60 includes a turning shaft 61 having a rotation center in the left-right direction, and is turnable with respect to the frame 94. The second contact member 60 includes a lever part 62 formed in a plate shape extending in the front-rear direction with the turning shaft 61 at the center, and the protruding part 63 with a columnar shape protruding in the left-right direction is provided at one end portion of the lever part 62. In addition, in the second contact member 60, a turning shaft 64 having a rotation center in the left-right direction is formed at the other end portion of the lever part 62, and a roller 65 composed of an elastic member or the like is supported such that it is turnable around the turning shaft 64.

The turning shaft 61 that rotates the second contact member 60 is disposed upstream of the roller 65 in the ejection direction B. In addition, in the present embodiment, the roller 65 functions as a contact part that makes contact with the ejected medium (the single sheet medium S1). The roller 65 serving as the contact part is pressed to the loading surface 911 by the weight of the second contact member 60. Note that the roller 65 may be pressed to the loading surface 911 side by a pressing member (omitted in the drawing) or the like other than the weight of the second contact member 60.

The second contact member 60 has the detection position indicated with the solid line in FIG. 10 as a basic position. In addition, when the load detection mechanism 5, except for the second contact member 60, is located at the open position and the detection position, the second contact member 60 is located at the detection position. Note that when the load detection mechanism 5, except for the second contact member 60, is at the open position, a position where the second contacting part 74 is at the lower side is set; however, the second contact member 60 is located at the detection position indicated with the solid line with a supporting part provided in the frame 94 omitted in the drawing.

In the second contact member 60, when the roller 65 is brought into contact with the ejected medium and pushed up, the second contact member 60 rotates clockwise around the turning shaft 61 in a right side view. With this clockwise rotation of the second contact member 60, the protruding part 63 presses the second contacting part 74 (the contact surface 74*a*) of the detection auxiliary member 70 downward and displaces the second contacting part 74.

When the second contacting part 74 is displaced downward, the detection auxiliary member 70 rotates counterclockwise around the third turning shaft 181 in a right side view. Note that in the present embodiment, as illustrated in FIG. 10, when the second contact member 60 is rotated to the detection confirmation position indicated by the chain double-dashed line, the detection auxiliary member 70 is rotated by receiving the rotation, and thus the light shielding plate 75 is located at a position where it blocks the light between the light emission part and the light reception part of the optical sensor 41.

A way of detecting an ejected medium is described below.

In the present embodiment, when a medium with a small bending rigidity is ejected after the recording, the medium tends to be warped into a downward convex shape in a side view in the ejection direction B. In addition, when a medium with a large bending rigidity is ejected after the recording, the medium tends to be warped into an upward convex shape (opposite the medium with a small bending rigidity) in a side view in the ejection direction B. Plain paper and the like have a small bending rigidity, and therefore tend to be warped into a downward convex shape.

In the present embodiment, the first contact member 50 makes contact with the medium with a downward convex warp, and thus the height of the ejected medium is detected. In addition, the second contact member 60 makes contact with the medium with an upward convex warp, and thus the height of the ejected medium is detected.

Note that both the first contact member 50 and the second contact member 60 detect a high portion of the ejected medium. Specifically, in the present embodiment, the first contact member 50 detects the load amount (load height) by making contact with the medium with a downward convex warp at the position of an upstream end portion (upstream end Sla) as a high portion of the ejected medium in the ejection direction B. In addition, the second contact member 60 detects the load amount (load height) by making contact with the medium with an upward convex warp at the position of a center portion (center portion Sib) as a high portion at a downstream position of the ejected medium in the ejection direction B. Note that the first contact member 50 and the second contact member 60 make contact with the ejected medium and thus operate in conjunction with the displacement of the amount of media that have been ejected and loaded.

In the following description, in the present embodiment, both a medium with a downward convex warp and a medium with an upward convex warp are referred to as the single sheet medium S1, and the names "upstream end S1*a*" and "center portion Sib" are also commonly used to indicate portions of the single sheet medium S1.

The first contact member 50 is provided on the upper side of a position where the upstream end S1*a* of the single sheet medium S1 is loaded when the ejected single sheet medium S1 is loaded. In addition, the second contact member 60 is provided on the upper side of a position where the center portion Sib, not the upstream side or downstream side end portion of the single sheet medium S1, is loaded when the ejected single sheet medium S1 is loaded. Therefore, the first contact member 50 and the second contact member 60 do not overlap each other and do not make contact with each other in a side view in the ejection direction B.

In addition, in the present embodiment, when the ejected single sheet medium S1 is loaded on the loading surface 911 of the stacker 90, it is sequentially loaded in the state where the region of the upstream end S1*a* of the single sheet medium S1 is located at the top surface of a load auxiliary plate 29 provided upstream of the third guide part 35 and the third guide part 35 of the guide member 30. The guide member 30 and the load auxiliary plate 29 constitute a part of the loading unit 91 (the loading surface 911) when the single sheet medium S1 is loaded to the stacker 90.

A timing of detecting the single sheet medium S1 at the first contact member 50 and the second contact member 60 is described below.

In the present embodiment, as the detection timing of the detection unit 40, the detection is performed at a timing when the single sheet medium S1 is ejected and falls downward toward the loading surface 911 (the load auxiliary plate 29). Therefore, during the recording by the recording unit 13 on a medium (the long medium S), the detection is not performed even when the downstream front end portion of the long medium S is brought into contact with the first contact member 50 and displaced to the detection confirmation position. The detection is performed at the timing when, after the medium (the long medium S) is cut at the cutting part 15, the single sheet medium S1 nipped by the ejection roller pair 16 is ejected in the ejection direction B and the single sheet medium S1 falls down on the loading surface 911.

Accordingly, the first contact member 50 detects the position of the upstream end S1*a* at the timing when the upstream end S1*a* of the single sheet medium S1 falls down, and, when it is displaced to the detection confirmation position (when the light of the optical sensor 41 is blocked), the detection unit 40 sends a signal "ON" to the control unit 24. In addition, when it is not displaced to the detection confirmation position (when the light of the optical sensor 41 is not blocked), the detection unit 40 sends a signal "OFF" to the control unit 24. In addition, at the timing when the upstream end S1*a* of the single sheet medium S1 falls down, the second contact member 60 detects the position of the center portion Sib, and when it is displaced to the detection confirmation position (when the light of the optical sensor 41 is blocked), the detection unit 40 sends a signal "ON" to the control unit 24. In addition, when it is not displaced to the detection confirmation position (when the light of the optical sensor 41 is not blocked), the detection unit 40 sends a signal "OFF" to the control unit 24.

In the present embodiment, when either the first contact member 50 or the second contact member 60 is displaced to the detection confirmation position, the control unit 24 receives a signal "ON" from the detection unit 40, and makes a request for stopping the ejection of the single sheet medium S1. In addition, it makes a request for stopping a series of operations related to stopping the ejection of the single sheet medium S1.

Note that when the first contact member 50 and the second contact member 60 are displaced to the detection confirmation position, normally, this is a case where the load amount (load height) of the single sheet medium S1 loaded on the loading surface 911 reaches a set predetermined load amount, and the ejection of the single sheet medium S1 is stopped by the control unit 24. However, in some situations, the first contact member 50 and the second contact member 60 may be displaced to the detection confirmation position when the load amount (load height) of the single sheet medium S1 does not reach the set predetermined load amount. In this case, it is likely that a large warp such as a downward convex warp or an upward convex warp of the single sheet medium S1 is included, and defects such as a paper jam may occur if ejection is continued, and therefore ejection of the single sheet medium S1 is stopped.

When the detection unit 40 determines that the detection auxiliary member 70 (the light shielding plate 75) is displaced and the height of the single sheet medium S1 loaded on the loading surface 911 has exceeded a predetermined value, the control unit 24 makes a request for stopping ejection of the single sheet medium S1. In addition, the control unit 24 detects, at the detection unit 40, the state of the detection auxiliary member 70 (the light shielding plate 75) at the timing when the upstream end S1*a* of the single sheet medium S1 is ejected from the sheet ejection unit 17 and loaded (or falls down) to the loading surface 911.

According to the present embodiment, the following effects can be achieved.

The recording apparatus 1 of the present embodiment includes the recording unit 13 configured to perform recording on a medium having a sheet shape, the sheet ejection unit 17 configured to eject the medium after the recording, the loading unit 91 including the loading surface 911 on which the medium (the single sheet medium S1), after being ejected, is loaded, and the first contact member 50 configured to make contact with the position of the upstream end Sla of the single sheet medium S1 in the ejection direction B and operate in conjunction with the displacement of the load amount of the single sheet medium S1. In addition, the recording apparatus 1 includes the second contact member 60 configured to make contact with a downstream position (the center portion Sib) of the single sheet medium S1 in the ejection direction B with respect to the first contact member 50 and operate in conjunction with the displacement of the load amount of the single sheet medium S1, one detection auxiliary member 70 configured to be displaced in conjunction with the displacement of the first contact member 50 and the second contact member 60, and the detection unit 40 configured to detect the displacement of the detection auxiliary member 70.

When the recording apparatus 1 has the above-mentioned configuration, the first contact member 50 can operate in conjunction with the displacement of the load amount of the medium at the position of the upstream end S1*a* in the ejection direction B for the medium (the single sheet medium S1) with a downward convex shape in a side view in the ejection direction B. In addition, the second contact member 60 can operate in conjunction with the displacement of the load amount of the medium at a downstream position (the center portion Sib) in the ejection direction B for a medium (the single sheet medium S1) with an upward convex shape in a side view in the ejection direction B.

Thus, for a medium warped in a downward convex shape and a medium warped in an upward convex shape in a side view in the ejection direction B, it is possible for the first contact member 50 and the second contact member 60 to properly operate in conjunction with the displacement of the load amount, and to properly detect the displacement. In this manner, it is possible to prevent pushing out of a previously loaded medium by the ejected medium, buckling of the ejected medium due to collision with a previously loaded medium, and the like.

In the recording apparatus 1 of the present embodiment, in the loading unit 91, the single sheet medium S1 is moved toward one end portion side in the width direction intersecting the ejection direction B while being ejected, and the first contact member 50 and the second contact member 60 are disposed on the one end portion side in the width direction.

With this configuration, the single sheet medium S1 is moved toward one end portion side in the width direction while being ejected. Thus, the first contact member 50 and the second contact member 60 need only be disposed on the one end portion side in the width direction, and the first contact member 50 and the second contact member 60 need not be provided on the other end portion side in the width direction, and therefore, the configuration can be simplified. In addition, a plurality of media with different sizes in the width direction can be handled.

In the recording apparatus 1 of the present embodiment, the detection auxiliary member 70 includes the first contacting part 73 with which the first contact member 50 makes contact, the second contacting part 74 with which the second contact member 60 makes contact, and the light shielding plate 75 as a detection object part to be detected by the detection unit 40.

With this configuration, the detection auxiliary member 70 that displaces the light shielding plate 75 in conjunction with the displacement of the first contact member 50 and the second contact member 60 can be configured with one member, and thus the number of components can be reduced.

In the recording apparatus 1 of the present embodiment, the first contact member 50 includes the turning part 52 that turns with respect to the second turning shaft 166, the second contact member 60 includes the turning shaft 61, and the detection auxiliary member 70 includes the turning part 71 that turns with respect to the third turning shaft 181. Thus, the detection auxiliary member 70 turns in conjunction with the turning of any one of the first contact member 50 and the second contact member 60.

With this configuration, the detection auxiliary member 70 can separately operate in conjunction with the turning of the first contact member 50 and the turning of the second contact member 60.

In the recording apparatus 1 of the present embodiment, the first contact member 50 and the second contact member 60 do not make contact with each other.

With this configuration, the first contact member 50 and the second contact member 60 do not make contact with each other, and it is thus possible to operate the first contact member 50 and the second contact member 60 independently of each other in conjunction with the displacement of the load amount of the single sheet medium S1.

In the recording apparatus 1 of the present embodiment, each of the first contact member 50 and the second contact member 60 includes the roller 65 and the contact part 53 configured to make contact with the single sheet medium S1 that is loaded onto the loading surface 911 of the loading unit 91. The turning part 52 of the first contact member 50 that turns with respect to the second turning shaft 166 is disposed upstream of the contact part 53 in the ejection direction B. In addition, the turning shaft 61 of the second contact member 60 is disposed upstream of the roller 65 in the ejection direction B.

With this configuration, it is possible to suppress the single sheet medium S1 ejected in the ejection direction B from interfering with the ejection operation.

In the recording apparatus 1 of the present embodiment, the contact part 53 of the first contact member 50 and the roller 65 as the contact part of the second contact member 60 are pressed to the loading surface 911 side.

With this configuration, the contact part 53 is pressed by the weight of the first contact member 50 to the loading surface 911 side, and the roller 65 is pressed by the weight of the second contact member 60 to the loading surface 911 side, and thus, it is possible to properly operate the contact part 53 and the roller 65 in conjunction with the displacement of the load amount.

In the recording apparatus 1 of the present embodiment, the single sheet medium S1 is obtained by cutting a roll-shaped medium (the roll sheet R). With this configuration, in an apparatus using the roll sheet R, the load amount of the single sheet medium S1 can be properly detected.

The recording apparatus 1 of the present embodiment includes the control unit 24 configured to control the ejection operation of the single sheet medium S1, and, when the detection unit 40 determines that the detection auxiliary member 70 is displaced and the height of the single sheet medium S1 loaded to the loading surface 911 is greater than the predetermined value, the control unit 24 stops the ejection of the single sheet medium S1.

With this configuration, the control unit 24 stops the ejection of the single sheet medium S1 when it is determined that the height (load amount) of the single sheet medium S1 is greater than the predetermined value, and thus stable ejection can be performed. In addition, even with single sheet media S1 largely warped in an upward convex shape and a downward upward convex shape, defects such as a paper jam can be prevented beforehand through detection and stoppage of ejection of the single sheet medium S1.

In the recording apparatus 1 of the present embodiment, the control unit 24 detects the state of the detection auxiliary member 70 (the light shielding plate 75) at the detection unit 40 at the timing when the upstream end S1*a* of the single sheet medium S1 is ejected from the sheet ejection unit 17 and loaded onto the loading surface 911.

With this configuration, a variation in the load amount of the single sheet medium S1 can be correctly detected.

2. Modification 1

In the present embodiment, the detection auxiliary member 70 includes the third turning shaft 181 as a turning shaft, and freely turns. However, this is not limitative, and the holding member 180 may perform holding in a turnable manner using the turning part 71 as a turning shaft without using the third turning shaft 181. In this case, the holding member 180 may perform holding in a turnable manner with the turning part 82 as a turning shaft by aligning the axis center with the turning part 71 together with the turning part 82 of the transmission member 80.

3. Modification 2

In the present embodiment, the first contact member 50 is provided on the recording apparatus 1 side. However, this is not limitative, and the first contact member 50 may be provided on the stacker 90 side.

In this case, the stacker 90 serving as a medium housing apparatus may include the loading unit 91 including the loading surface 911 on which the medium (the single sheet medium S1), after being ejected, is loaded, and the first contact member 50 that makes contact with the position of the upstream end S1*a* of the single sheet medium S1 in the ejection direction B and operates in conjunction with the displacement of the load amount of the single sheet medium S1. In addition, the stacker 90 may include the second contact member 60 that makes contact with a downstream position (the center portion Sib) of the single sheet medium S1 in the ejection direction B with respect to the first contact member 50 and operates in conjunction with the displacement of the load amount of the single sheet medium S1, one detection auxiliary member 70 that is displaced in conjunction with the displacement of the first contact member 50 and the second contact member 60, and the detection unit 40 that detects the displacement of the detection auxiliary member 70.

When the stacker 90 has the above-mentioned configuration, the first contact member 50 can operate in conjunction with the displacement of the load amount of the medium at the position of the upstream end S1*a* in the ejection direction B for the medium (the single sheet medium S1) with a downward convex shape in a side view in the ejection direction B. In addition, the second contact member 60 can operate in conjunction with the displacement of the load amount of the medium at a downstream position (the center portion Sib) in the ejection direction B for a medium (the single sheet medium S1) with an upward convex shape in a side view in the ejection direction B. Thus, for a medium warped in a downward convex shape or a medium warped in an upward convex shape in a side view in the ejection direction B, it is possible for the first contact member 50 and the second contact member 60 to properly operate in conjunction with the displacement of the load amount, and to properly detect the displacement. In this manner, it is possible to prevent pushing out of a previously loaded medium by the ejected medium, buckling of the ejected medium due to collision with a previously loaded medium, and the like.

What is claimed is:

1. A recording apparatus comprising:

a recording unit configured to perform recording on a medium having a sheet shape;

a sheet ejection unit configured to eject the medium after the recording;

a loading unit including a loading surface on which the medium, after being ejected, is loaded;

a first contact member configured to make contact with a position of an upstream end of the medium in an ejection direction and operate in conjunction with a displacement of a load amount of the medium;

a second contact member configured to make contact with a downstream position of the medium in the ejection direction with respect to the first contact member and operate in conjunction with the displacement of the load amount of the medium;

one detection auxiliary member configured to make a displacement in conjunction with a displacement of the first contact member and the second contact member; and a detection unit configured to detect the displacement of the detection auxiliary member, wherein the medium is moved toward one end portion side of the loading unit in a width direction intersecting the ejection direction while being ejected; and the first contact member and the second contact member are disposed on the one end portion side of the loading unit in the width direction.

2. The recording apparatus according to claim 1, wherein the detection auxiliary member includes a first contacting part with which the first contact member makes contact, a second contacting part with which the second contact member makes contact, and a to-be-detected part configured to be detected by the detection unit.

3. The recording apparatus according to claim 1, wherein each of the first contact member, the second contact member and the detection auxiliary member includes a turning shaft; and the detection auxiliary member turns in conjunction with turning of any one of the first contact member and the second contact member.

4. The recording apparatus according to claim 1, wherein the first contact member and the second contact member do not make contact with each other.

5. The recording apparatus according to claim 3, wherein each of the first contact member and the second contact member includes a contact part configured to make contact with the medium that is loaded onto the loading surface of the loading unit; and each of the turning shafts of the first contact member, the second contact member and the detection auxiliary member is disposed at a position upstream of the contact part in the ejection direction.

6. The recording apparatus according to claim 5, wherein the contact part of each of the first contact member and the second contact member is pressed to the loading surface side.

7. The recording apparatus according to claim 1, wherein the medium is obtained by cutting a roll-shaped medium.

8. The recording apparatus according to claim 1, comprising a control unit configured to control an ejection operation of the medium, wherein when the detection unit determines that the detection auxiliary member is displaced and a height of the medium loaded on the loading surface is greater than a predetermined value, the control unit stops ejection of the medium.

9. The recording apparatus according to claim 8, wherein at a timing when the upstream end of the medium is ejected from the sheet ejection unit and loaded onto the loading surface, the control unit detects a state of the detection auxiliary member, at the detection unit.

10. A medium housing apparatus comprising:

a loading unit including a loading surface on which the medium, after being ejected, is loaded;

a first contact member configured to make contact with a position of an upstream end of the medium in an ejection direction and operate in conjunction with a displacement of a load amount of the medium;

a second contact member configured to make contact with a downstream position of the medium in the ejection direction with respect to the first contact member and operate in conjunction with the displacement of the load amount of the medium;

one detection auxiliary member configured to make a displacement in conjunction with a displacement of the first contact member and the second contact member; and a detection unit configured to detect the displacement of the detection auxiliary member, wherein the medium is moved toward one end portion side of the loading unit in a width direction intersecting the ejection direction while being ejected; and the first contact member and the second contact member are disposed on the one end portion side of the loading unit in the width direction.

* * * * *